United States Patent [19]

Sresty et al.

[11] Patent Number: 4,485,869

[45] Date of Patent: Dec. 4, 1984

[54] RECOVERY OF LIQUID HYDROCARBONS FROM OIL SHALE BY ELECTROMAGNETIC HEATING IN SITU

[75] Inventors: Guggilam C. Sresty; Richard H. Snow, both of Chicago; Jack E. Bridges, Park Ridge, all of Ill.

[73] Assignee: IIT Research Institute, Chicago, Ill.

[21] Appl. No.: 435,979

[22] Filed: Oct. 22, 1982

[51] Int. Cl.[3] ..... E21B 43/24

[52] U.S. Cl. ..... 166/248; 166/263; 166/302

[58] Field of Search ..... 166/248, 263, 272, 302

[56] References Cited

U.S. PATENT DOCUMENTS

| | | | |
|---|---|---|---|
| Re. 30,738 | 9/1981 | Bridges et al. | 166/248 |
| 4,135,579 | 1/1979 | Rowland et al. | 166/248 |
| 4,140,179 | 2/1979 | Kasevich et al. | 166/248 |
| 4,140,180 | 2/1979 | Bridges et al. | 166/248 |
| 4,144,935 | 3/1979 | Bridges et al. | 166/248 |
| 4,193,451 | 3/1980 | Dauphine | 166/248 |
| 4,265,307 | 5/1981 | Elkins | 166/248 |
| 4,301,865 | 11/1981 | Kasevich et al. | 166/248 |
| 4,396,062 | 8/1983 | Iskander | 166/248 |

OTHER PUBLICATIONS

J. E. Bridges et al., Net Energy Recoveries for the In Situ Dielectric Heating of Oil Shale, 11th Oil Shale Symposium, Apr. 12–14, 1978.

R. H. Snow et al., Comparison of Dielectric Heating and Pyrolysis of Eastern and Western Oil Shales, 12th Oil Shale Symposium, Apr. 1979.

J. E. Bridges et al., Radio-Frequency Heating to Recover Oil From Utah Tar Sands, May 1979.

R. D. Carlson et al., Development of the IIT Research Institute RF Heating Process for In Situ Oil Shale/Tar Sand Fuel Extraction—An Overview, Proceedings of the 14th Oil Shale Symposium, Apr. 22–24, 1981.

R. Mallon, Economics of Shale Oil Production by Radio Frequency Heating, Report No. UCRL-52942, Lawrence Livermore Laboratory, May 7, 1980.

J. E. Bridges et al., Physical and Electrical Properties of Oil Shale, 4th Annual Oil Shale Conversion Conference, Mar. 24–26, 1981.

G. C. Sresty, et al., Recovery of Bitumen From Tar Sand Deposits Using the IITRI RF Process, Society of Petroleum Engineers of AIME, SPE 10229, Oct. 5–7, 1981.

R. Snow, et al., The IITRI RF Process for Oil Shale—Recent Developments, Symposium Papers, Synthetic Fuels from Oil Shale-II, pp. 367–390, Oct. 26–29, 1981.

R. H. Snow, et al., The IITRI RF Process—Laboratory and Field Results on Oil Shale and Tar Sand, Proceedings of the Ninth Energy Technology Conference, Feb. 16–18, 1982.

G. C. Sresty, et al., The IITRI RF Process to Recover Bitumen from Tar Sand Deposits—A Progress Report, II International Conference on Heavy Crude and Tar Sands, vol. III, pp. 1–24, Feb. 7/17, 1982.

G. C. Sresty, et al., Kinetics of Low-Temperature Pyrolysis of Oil Shale by the IITRI RF Process, Fifteenth Oil Shale Symposium Proceedings, pp. 411–423, Apr. 28–30, 1982.

*Primary Examiner*—George A. Suchfield

*Attorney, Agent, or Firm*—Fitch, Even, Tabin & Flannery

[57] ABSTRACT

A method of electromagnetic heating in situ recovers liquid hydrocarbons from an oil shale formation containing kerogen in an inorganic matrix where the formation is substantially impermeable to fluids under native conditions. A block of the oil shale formation is substantially uniformly heated in situ with electromagnetic power to a temperature of about 275° C. where there is pyrolysis of a portion of the kerogen to gas and shale oil at a pressure sufficient to overcome the capillary pressure of the shale oil in the matrix, thereby providing substantial fluid permeability to the formation. The gas thereupon escaping from said block and the shale oil driven thereby are recovered, thereby further increasing the permeability of the formation. The magnitude of the electromagnetic power is controlled to raise the temperature of the block relatively slowly to increase the rate of pyrolysis of the kerogen as the permeability of the formation increases to produce gas at pressures above the necessary to overcome the capillary pressure and below that at which there is substantial escape of the gas bypassing shale oil within the formation rather than driving the oil before it.

14 Claims, 9 Drawing Figures

RECOVERY OF LIQUID HYDROCARBONS FROM OIL SHALE BY ELECTROMAGNETIC HEATING IN SITU

BACKGROUND OF THE INVENTION

This invention relates generally to the recovery of marketable products such as oil and gas from substantially fluid impermeable oil shale deposits of kerogen in an inorganic matrix by the application of electromagnetic energy to heat the deposits. More specifically, the invention relates to a method for recovering shale oil from such formations by controlled electromagnetic heating to pyrolyze the kerogen to gas and shale oil at pressures sufficient to drive out the oil, while controlling the electromagnetic power to limit the temperature rise to keep down wasteful coking and cracking. The invention relates to such method including use of a high power radio frequency signal generator and an arrangement of elongated electrodes inserted in the earth formations for applying electromagnetic energy to provide controlled heating of the formations.

Vast amounts of hydrocarbons are contained in deposits from which they cannot be produced by conventional oil production techniques because the hydrocarbon deposits are not fluid and/or the formations are substantially fluid impermeable. Such deposits include oil shales.

It is well known to mine oil shale, heating the mined oil shale on the surface of the earth to an appropriate temperature, and recovering the products thereupon released from the matrix by pyrolysis or distillation. The volume of material to be handled, as compared to the amount of recovered product, is relatively large. Material handling of oil shale is particularly difficult even under the best of conditions, and the problems of waste disposal are substantial.

A number of proposals have been made for in situ methods of processing and recovering valuable products from hydrocarbonaceous deposits. Such methods may involve underground heating or retorting of material in place, with little or no mining or disposal of solid material in the formation. Valuable constituents of the formation, including products of pyrolysis, may be drawn to the surface by a pumping system or forced to the surface by injecting another substance into the formation. It is important to the success of such methods that the amount of energy required to effect the extraction be minimized.

It has been known to heat relatively large volumes of hydrocarbonaceous formations in situ using radio frequency energy. This is disclosed in Bridges and Taflove U.S. Pat. No. Re. 30,738. That patent discloses a system and method for in situ heat processing of hydrocarbonaceous earth formations wherein a plurality of conductive means are inserted in the formations and bound a particular volume of the formations. As used therein, the term "bounding a particular volume" was intended to mean that the volume was enclosed on at least two sides thereof. In the most practical implementations, the enclosed sides were enclosed in an electrical sense, and the conductors forming a particular side could be an array of spaced conductors. Electrical excitation means were provided for establishing alternating electric fields in the volume. The frequency of the excitation means was selected as a function of the dimensions of the bounded volume so as to establish a substantially non-radiating electric field which was substantially confined in such volume. In this manner, volumetric dielectric heating of the formations occurred to effect approximately uniform heating of the volume.

In the preferred embodiment of the system described in that patent, the frequency of the excitation was in the radio frequency range and had a frequency between about 100 KHz and 100 MHz. In that embodiment, the conductive means comprised conductors disposed in respective opposing spaced rows of boreholes in the formations. One structure employed three spaced rows of conductors which formed a triplate type of waveguide structure. The stated excitation was applied as a voltage, for example, between different groups of the conductive means or as a dipole source, or as a current which excited at least one current loop in the volume. Particularly as the energy was coupled to the formations from electric fields created between respective conductors, such conductors were, and are, often referred to as electrodes. The reissue patent disclosed application of the triplate heating method to oil shales at columns 15 and 16, mentioning pyrolysis in the range of 400° C. to 500° C.

Dauphine U.S. Pat. No. 4,193,451 suggested a temperature range on the order of 200° C. to 360° C. for the thermal decomposition of kerogen to produce shale oil and gases using RF energy. Dauphine recognized that shale was generally impervious without suitable fractures and suggested fracturing methods to enhance flow of the shale oil and gases toward one of the wells. More specifically, Dauphine suggested fracturing the shale by the application of RF heating and then maintaining pressure to keep the resulting fissures open, as by external fluid injection or the vaporization of water and/or hydrocarbons and/or the decomposition of temperature sensitive carbonate minerals.

SUMMARY OF THE INVENTION

Materials such as oil shales are amenable to heat processing to produce gases and hydrocarbonaceous liquids. Generally, the heat develops the permeability and/or mobility necessary for recovery. Oil shale is a mixture of kerogen in a shale matrix. Using various types of heat processing, the kerogen can be decomposed and recovered.

The present invention is an improvement upon the method described in U.S. Pat. No. Re. 30,738 and may utilize the same sort of waveguide structure, preferably in the form of the same triplate transmission line. The teachings of that reissue patent are hereby incorporated herein by reference.

In the performance of the method of the reissue patent in oil shales, it was observed that under conditions of rapid heating to high temperatures gas was produced along with shale oil at high pressures. Although the gas inherently drove some liquid from the formations, no particular effort was made to control the production of the gas. In general, it was contemplated that the system of the reissue patent be used to heat the oil shale to temperatures around 500° C., as mentioned in column 16. It was there stated that interconnecting voids would form during pyrolysis in the 400° C. to 500° C. range, providing permeability. A specific temperature for pyrolysis at 425° C. was stated in column 17. It was contemplated that the formations be heated as fast as practical to these elevated temperatures as long times gave more time for thermal conduction loss, which is considerable at such high temperatures.

Although high temperatures result in a more rapid conversion of kerogen to shale oil, according to the present invention greater recovery may be effected by more moderate heating, limiting coking and cracking. It has now been discovered that rapid heating to high temperatures decomposes kerogen faster than the products can be recovered and subjects the products of decomposition to high temperatures and pressures for long times whereby cracking and coking take place. The cracking produces less valuable hydrocarbons and coking leaves solid carbon in the formation. Therefore, in accordance with the present invention, permeability development and pyrolysis reactions are caused to proceed together so as not to build up excessive pressures and temperatures. Rather, the kerogen is pyrolyzed relatively gently at lower temperatures at rates at which the shale oil can be effectively recovered as the permeability is developed.

The present invention is also an improvement upon the method described in Dauphine U.S. Pat. No. 4,193,451. As stated above, Dauphine provides fracturing to produce fissures through which the products of the pyrolysis of kerogen can be recovered and provides means for assuring that the fissures remain open. Fracturing has two grievous defects that are overcome by the present invention. In the first place, fracturing by high pressure gradients and thermal stresses requires relatively rapid heating. This creates products of pyrolysis faster than they can be recovered, resulting in undesired coking with a consequent decrease in permeability and loss of product. Secondly, the fissures provide paths through which any vapors produced can escape without driving the shale oil before it, leaving the shale oil behind because of its lower mobility.

Another process for recovering shale oil from oil shale is disclosed in Elkins U.S. Pat. No. 4,265,307. The Elkins process utilizes the triplate array of the reissue patent and rubblizes the oil shale before application of the RF energy. This further shows the efforts of the prior art in fracturing the shale to provide fissures for recovery of the shale oil. This process suffers the shortcomings of Dauphine to an even greater degree.

Mallon, "Economics of shale oil production by radio frequency heating," Lawrence Livermore Laboratory Report UCRL-52942 (1980), suggested producing the shale oil from a monolithic (unfractured) block by the development of interconnecting void spaces such as described in the U.S. Pat. No. Re 30,738. However, Mallon suggested a very fast heating rate of about 7.5° C./hr as opposed to the much slower heating rates considered in this application, approximately 0.2° C./hr.

Thus, in accordance with the present invention, the formations are heated substantially uniformly with electromagnetic power to temperatures of 250° C. to 275° C. At these temperatures, water present will have boiled off and kerogen starts to decompose. Fluid permeability begins to develop, and the gas pressures developed by the decomposition of the kerogen drives off the liquid shale oil produced. The viscosity of the shale oil is relatively low at such temperatures. Only a few psi of gas pressure is needed to overcome the capillary pressure of the shale oil in the shale matrix. By heating the oil shale relatively slowly, e.g., at a rate of temperature increase of less than 0.2° C. per hour, the formations are kept cool enough that there is relatively little cracking and coking. Yet permeability of the formation and decomposition of the kerogen increase at a controlled pace so that the products of pyrolysis may be produced promptly without the buildup of high gas pressures. That is, the pyrolysis to form the reaction products is preferably carried out at such controlled rate that no more gas is produced than is necessary to force out shale oil in liquid form at a reasonable rate for the permeability then developed. As the permeability increases with the removal of some of the kerogen, the temperature is increased to produce gas faster and hence produce the shale oil faster. Even so, the formation is kept as cool as practical while producing appropriate permeability and kerogen decomposition.

A primary aspect of the invention is thus to provide an electromagnetic heating method for producing shale oil from oil shale formations that are substantially fluid impermeable in their native state, utilizing controlled pyrolysis of the kerogen to produce permeability and autogenous gas drive. These and other aspects, objectives and advantages of the present invention will become apparent from the following detailed description, particularly when taken in conjunction with the accompanying drawings.

DETAILED DESCRIPTION OF PREFERRED EMBODIMENTS

Figure 1:
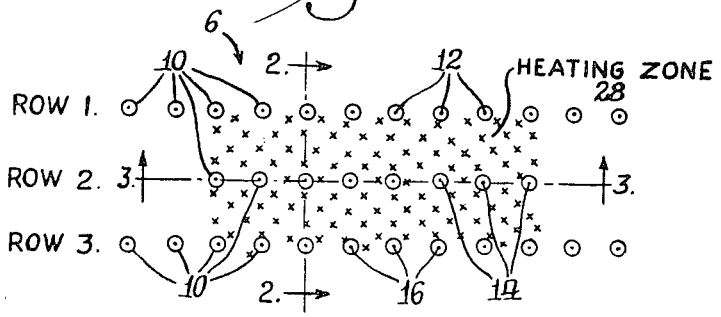
FIG. 1 is a plan view of a triplate waveguide structure disposed in earth formations in accordance with an embodiment of the present invention.
Figure 2:
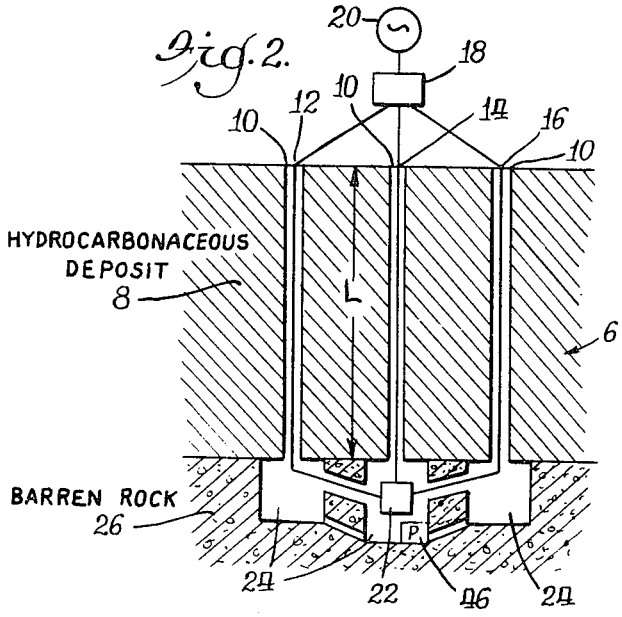
FIG. 2 is a vertical sectional view, partly diagrammatic, of the structure illustrated in FIG. 1, taken along line 2—2 in FIG. 1.
Figure 3:
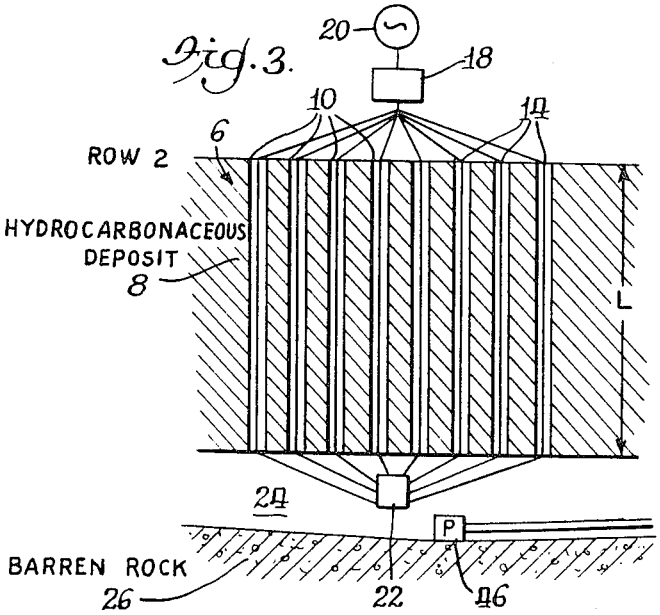
FIG. 3 is a vertical sectional view, partly diagrammatic, of the structure illustrated in FIG. 1, taken along line 3—3 in FIG. 1.

The present invention will be described primarily in respect to its application using a triplate waveguide structure as disclosed in Bridges and Taflove U.S. Pat. No. Re. 30,738. In FIGS. 1, 2 and 3 herein is illustrated a simplified construction of one form of a triplate waveguide structure 6 similar to the structure as shown in FIGS. 4*a*, 4*b* and 4*c* of the reissue patent utilizing rows of discrete electrodes to form the triplate structure. The most significant difference between the system illustrated in FIGS. 1, 2 and 3 herein and that illustrated in the reissue patent is in the termination of the waveguide structure at its lower end. It is, however, within the present invention to utilize either the systems illustrated herein or those of the reissue patent. Other types of waveguide structures could be used where at least two sides of the heated deposit are confined by electrodes.

FIG. 1 is a plan view of a surface of a hydrocarbonaceous deposit 8 having three rows 1, 2, 3 of boreholes 10 with elongated tubular electrodes 12, 14, 16 placed in the boreholes of respective rows to form the triplate waveguide 6. For the method of the present invention, the deposit 8 is an oil shale formation containing kerogen in an inorganic matrix, as occurs in the Western United States. Such formations in their native state are substantially impermeable to fluids.

The individual elongated tubular electrodes 12, 14, 16 are placed in respective boreholes 10 that are drilled in relatively closely spaced relationship in three straight and parallel rows 1, 2, 3, the central row 2 being flanked by rows 1 and 3. Electrodes 12 are in row 1, electrodes 14 in row 2, and electrodes 16 in row 3. The rows are spaced far apart relative to the spacing of adjacent electrodes of a row. FIG. 2 shows one electrode of each row. FIG. 3 illustrates the electrodes 14 of the central row, row 2.

In the embodiment shown, the boreholes 10 are drilled to a depth L into the formations, where L is the approximate thickness of the hydrocarbonaceous deposit 8. After insertion of the electrodes 12, 14, 16 into the respective boreholes 10, the electrodes 14 of row 2 are electrically connected together and coupled to one terminal of a matching network 18. The electrodes 12, 16 of the flanking outer rows are also connected together and coupled to the other terminal of the matching network 18. Power is applied to the waveguide structure 6 formed by the electrodes 12, 14, 16, preferably at radio frequency. Power is applied to the structure from a power supply 20 through the matching network 18, which acts to match the power source 20 to the waveguide 6 for efficient coupling of power into the waveguide. The lower ends of the electrodes are similarly connected to a termination network 22 which provides appropriate termination of the waveguide structure 6 as required in various operations utilizing the present invention. As the termination network 22 is below ground level and cannot readily be implanted or connected from the surface, lower drifts 24 are mined out of the barren rock 26 below the deposit 8 to permit access to the lower ends of the electrodes 12, 14, 16, whereby the termination network 22 can be installed and connected.

The zone 28 heated by applied energy is approximately that bounded by the electrodes 12, 16. The electrodes 12, 14, 16 of the waveguide structure 6 provide an effective confining waveguide structure for the alternating electric fields established by the electromagnetic excitation. The outer electrodes 12, 16 are commonly referred to as the ground or guard electrodes, the center electrodes 14 being commonly referred to as the excitor electrodes. Heating below L is minimized by appropriate termination of the waveguide structure at the lower end.

The use of an array of elongated cylindrical electrodes 12, 14, 16 to form a field confining waveguide structure 6 is advantageous in that installation of these units in boreholes 10 is more economical than, for example, installation of continuous plane sheets on the boundaries of the volume to be heated in situ. To achieve field confinement, the spacing between adjacent electrodes of a respective row should be less than about a quarter wavelength and preferably less than about an eighth of a wavelength.

Very large volumes of hydrocarbonaceous deposits can be heat processed using the described technique, for example, volumes of the order of $10^5$ to $10^6$ $m^3$ of oil shale. Large blocks can, if desired, be processed in sequence by extending the lengths of the rows of boreholes 10 and electrodes 12, 14, 16. Alternative field confining structures and modes of excitation are possible. Further field confinement can be provided by adding conductors in boreholes at the ends of the rows to form a shielding structure.

Figure 4:
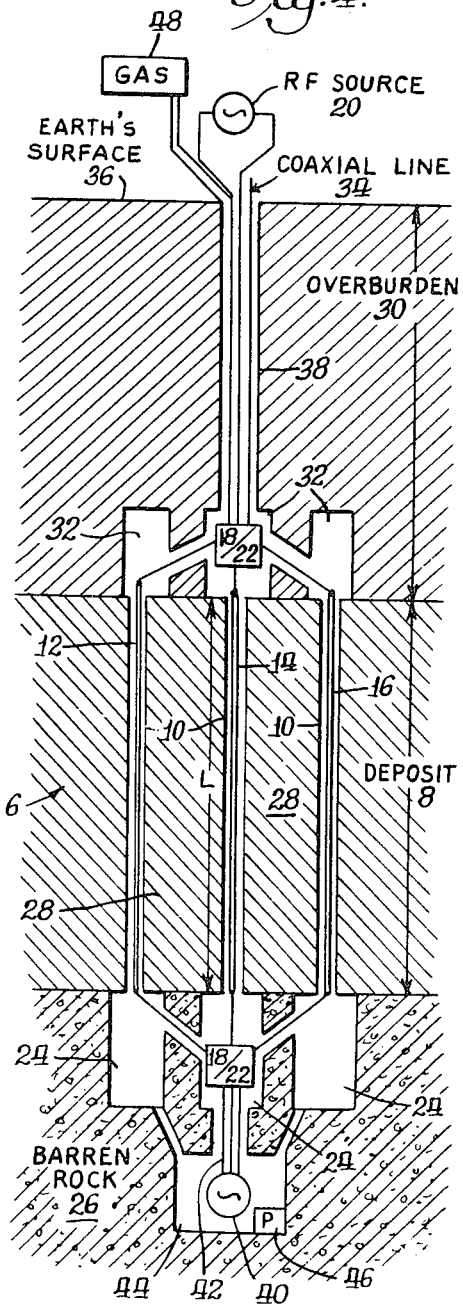
FIG. 4, is a vertical sectional view, partly diagrammatic, of another triplate waveguide structure for use in performing the present invention, wherein electromagnetic energy is applied at both ends of the waveguide structure, the view corresponding to the section taken in FIG. 2.

In FIGS. 1 to 3 it was assumed, for ease of illustration, that the hydrocarbonaceous earth formations formed a seam at or near the surface of the earth, or that any overburden had been removed. However, it will be understood that the invention is equally applicable to situations where the resource bed is less accessible and, for example, underground mining is required both above and below the deposit 8. In FIG. 4 there is shown a condition wherein a moderately deep hydrocarbonaceous bed 8, such as an oil shale layer of substantial thickness, is located beneath an overburden 30 of barren rock. In such instance, upper drifts 32 can be mined, and boreholes 10 can be drilled from these drifts. Again, each of these boreholes 10 represents one of a row of boreholes 10 for a triplate type configuration as is shown in FIG. 3. After the boreholes 10 have been drilled, respective tubular electrodes 12, 14 and 16 are lowered into the boreholes 10 in the resource bed 8. Coaxial lines 34 carry the energy from the power supply 20 at the surface 36 through a borehole 38 or an adit to the matching network 18 in a drift 32 for coupling to the respective electrodes 12, 14, 16. In this manner, there is no substantial heating of the barren rock of the overburden 30.

FIG. 4 illustrates an alternative embodiment of the present invention in that provision is made for applying power to the lower end of the triplate line 6 as well as to the upper end. To this end a second power supply 40 is provided at the lower end of the triplate line 6 and is coupled to a matching network 18 by a coaxial cable 42. The second power supply may be located in a drift 24 or in an adjacent drift 44, or it may be located at some distance, even at the surface. Indeed, the same power supply may be used for both ends of the line. In the embodiment shown in FIG. 4, a termination network 22 and a matching network 18 are supplied at each end of the waveguide structure 6. The termination/matching networks 18/22 may be of conventional construction for coupling the respective power supplies 20, 40 to the waveguide 6 and, upon switching, for terminating the waveguide with an appropriate impedance. With power applied from the upper power supply 20, the network 18 provides appropriate matching to the line, and the network 22 provides appropriate termination impedance. With power applied from the lower power supply 40, it is the other way around. The appropriate termination impedances will be whatever produces an appropriate phase of a standing wave or other desired property. Terminations for particular standing waves as produce certain desired heating patterns are set forth in the copending U.S. patent application of Bridges and Taflove, Ser. No. 343,903, filed Jan. 29, 1982, now U.S. Pat. No. 4,449,585, issued May 22, 1984, and assigned to the assignee hereof. The teachings of that application are hereby incorporated herein by reference.

The present invention will be described primarily in respect to its application using a triplate waveguide structure as disclosed in Bridges and Taflove U.S. Pat. No. Re. 30,738, although a biplate waveguide could be used under certain circumstances. In FIGS. 1 to 4 herein are illustrated simplified forms of a triplate waveguide structure for the heating of large volumes of oil shale in situ using vertically emplaced tubular electrodes. This type of structure is generally suitable for heating oil shale deposits that are over 50 ft. in vertical thickness. Another simplified form of triplate waveguide structure that can be utilized to heat the deposit if the thickness is less than about 50 ft. is the horizontal structure shown in FIG. 7 of the reissue patent. However, it is within the present invention to utilize either the systems specifically illustrated herein or those of the reissue patent.

A block of oil shale is confined by the two rows of guard electrodes 1 and 3 as illustrated in FIG. 1 and can be heated approximately uniformly to the desired temperature by application of electromagnetic energy as described above. Slow heating of the oil shale deposit to a temperature of over 100° C. will result in evaporation of the free water held within the shale matrix. However, a majority of the water held in United States oil shales is chemically combined with the inorganic shale matrix. This bound water can be vaporized to produce water vapor by slowly heating the shale to a temperature around 200° C., and the resulting water vapor can then be recovered. Water content in United States oil shales is typically in the range of 0.5 to 2% by weight. Vaporization of this water into water vapor induces some porosity and permeability, and results in recovery of the produced water vapor.

Further electromagnetic heating of oil shale approximately uniformly to temperatures in excess of 250° C. results in decomposition of kerogen to produce shale oil and gas. Once the permeability is sufficiently developed, the shale oil is driven from the formations into the respective boreholes 10 by the autogenous gas drive provided by decomposition of the kerogen. Upon reaching the boreholes 10, the shale oil drains by gravity into the lower drifts 24 and/or the drift 44 or suitable sumps, whence it can be pumped to the surface by pumps 46 for refining in a conventional manner into suitable products. The electrodes 12, 14, 16 may also be used to recover the oil. The gas produced may also be recovered through the electrodes 12, 14, 16 by means of a conventional gas collecting system 48 at the surface. The hydrocarbonaceous oil and gases are generally required to travel several feet through the hot shale before they are recovered through the electrodes. The pressure required to maintain the flow of the produced hydrocarbonaceous oil and gases through the shale and the time required for the said oil and gases to reach the electrodes depend on the permeability of the shale under current conditions and the rate of generation of the shale oil and gases. It is important to optimize the process so that the time required for the shale oil and gases to reach the electrodes is minimized. Extremely long times even at low temperatures result in the loss of valuable product by coking and/or cracking.

The time required to recover a substantial portion of the shale oil depends on the distance separating the tubular electrodes, since they can be perforated and used as recovery wells. The distance from the row 2 of excitor electrodes 14 to the flanking rows 1, 3 of guard electrodes 12, 16 should be between about 10 and 100 feet. If the spacing is too short, the gas is too rapidly produced and dissipated, and if the spacing is too great, it is difficult to realize uniform heating.

Thermal decomposition of kerogen to produce shale oil and gases is the result of a complicated set of chemical reactions that are difficult to isolate. However, the overall reaction can be quantified by considering a highly simplified reaction:

$$\text{kerogen} \rightarrow \text{shale oil} + \text{gases} \tag{1}$$

Figure 5:
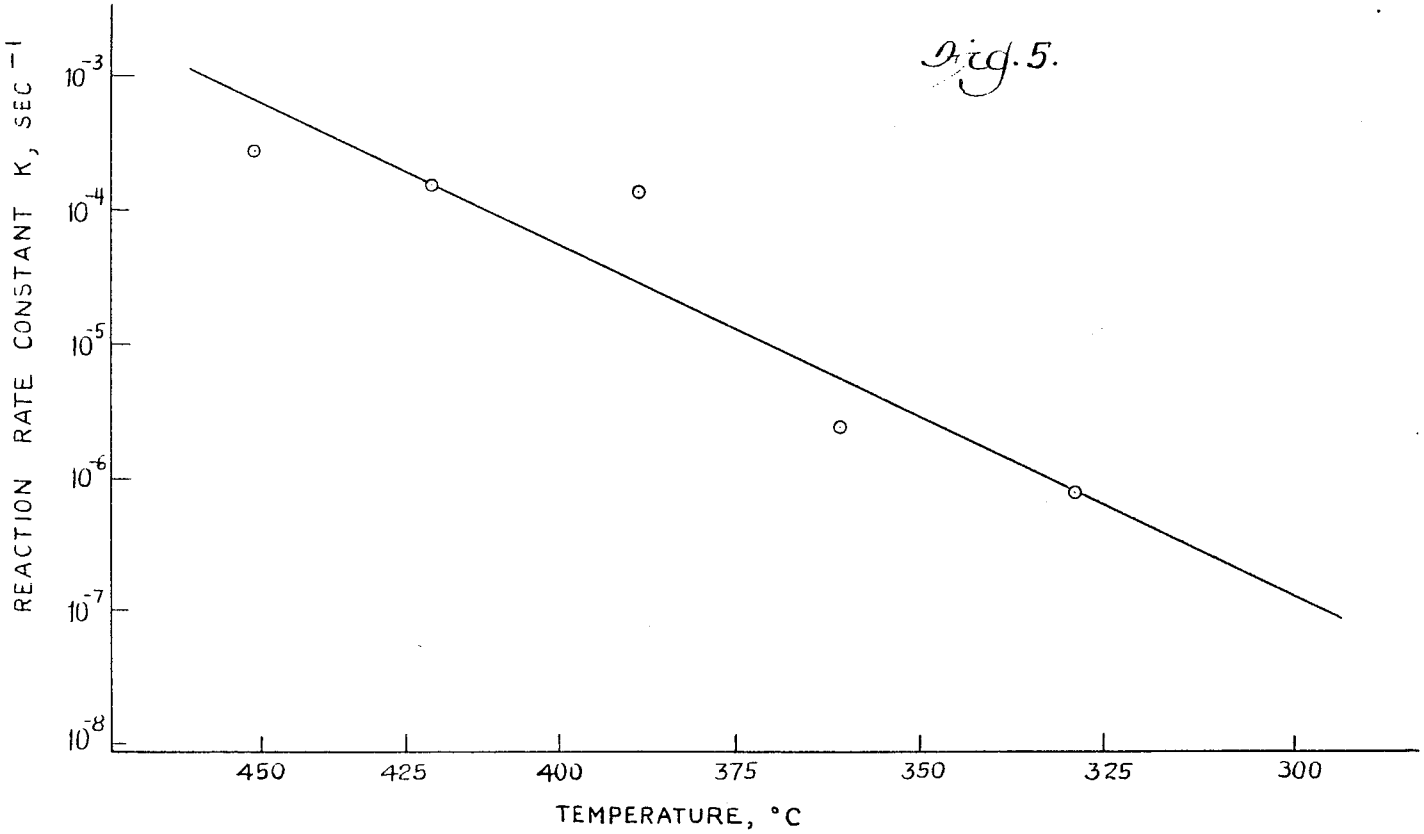
FIG. 5 is a graph showing the reaction constant k as a function of temperature for the pyrolysis of a typical Colorado oil shale from Anvil Points Mine.
Figure 6:
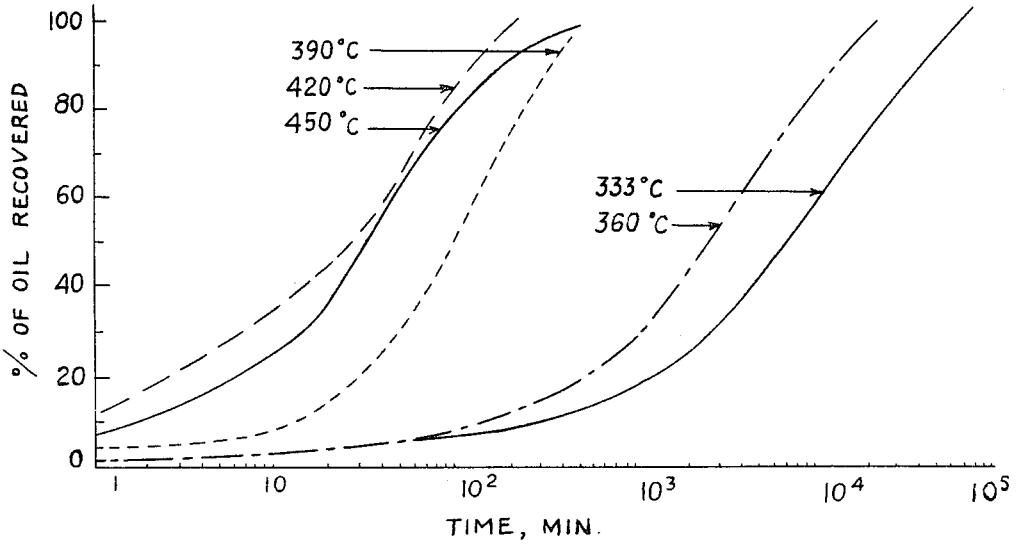
FIG. 6 is a graph showing the times required for producing shale oil from core samples of a typical Colorado oil shale from Anvil Points Mine at various temperatures.

The reaction rate constant k for this reaction can be calculated using laboratory data on rate of production of oil from heated oil shale core samples, assuming a first order rate equation:

$$\ln \frac{V_o}{V_o - V} = kt \tag{2}$$

where $V_o$ is the total volume of shale oil produced after the heating of a shale sample, V is the total volume of shale oil produced at any given time, k is a first order rate constant, and t is the elapsed time. The reaction rate constant is related to the temperature according to the equation:

$$k = A\exp(-\Delta E/RT) \tag{3}$$

where A is a frequency factor, ΔE is activation energy, R is the gas constant, and T is temperature in degrees Kelvin. The values of the reaction rate constant k are shown in FIG. 5 as a function of temperature for oil shale core samples from Colo. In the above equations, it is assumed that the shale oil is recovered as fast as it is produced by decomposition of kerogen. However, decomposition is faster than the rate at which shale oil can be recovered at temperatures of over 350° C., and this results in scatter of the experimental data as shown in FIG. 5. Times required to produce the shale oil by maintaining the core samples at different temperatures are shown in FIG. 6.

For commercial configurations of triplate waveguide structures 6 as illustrated in U.S. Pat. No. Re. 30,378, produced shale oil and gases are required to flow through several feet to several tens of feet of monolithic shale matrix before reaching one of the tubular electrodes 12, 14, 16 from which they can be recovered. As stated above, a temperature range for pyrolysis in the range of 400° C. to 500° C. was suggested in the reissue patent for the thermal decomposition of kerogen to produce shale oil and gases. High heating rates were contemplated to minimize heat losses by thermal conduction, which are significant in this temperature range. Laboratory experiments by the present applicants under similar conditions have now shown that extremely high pressures are produced when oil shale core samples from Colo. are heated to over 400° C. under simulated in situ conditions because the permeability developed failed to keep pace with decomposition of kerogen to produce shale oil and gas.

As stated above, Dauphine U.S. Pat. No. 4,193,451, suggested a temperature range in the order of 200° to 360° C. for the thermal decomposition of kerogen to produce shale oil and gases using RF energy. However, Dauphine, too, did not recognize the need for the slow development of the required permeability to permit flow of the shale oil and gases. Rather, Dauphine provided fracturing by heating to open fissures to enhance the flow of the shale oil and gases toward the wells. This is actually counterproductive, however, as the vapors produced by vaporization of volatile components within the deposit will preferentially flow into the fissures by channeling and will leave the shale oil behind because of adverse mobility ratios. Mobility ratio is the ratio of the viscosity of the driving fluid (the generated vapors) to the viscosity of shale oil liquids produced during the thermal decomposition of kerogen.

In neither the Bridges and Taflove U.S. Pat. No. Re. 30,738 nor the Dauphine U.S. Pat. No. 4,193,451 was any suggestion made for controlling the rate of thermal decomposition of kerogen so that the rate of generation of the products, shale oil and gases, was related to the rate at which they can flow through the shale matrix without causing excessive pressures at current permeability levels. The present invention is, therefore, an improvement on the above methods of both, providing a method for controlling and limiting the rate of decomposition of kerogen so that the product shale oil and gases can flow through the matrix. More specifically, the method of the present invention induces permeability within the shale matrix without any substantial fracturing to form fissures, and utilizes the pressure caused by gases produced along with shale oil liquids to drive the shale oil through the matrix into one of the boreholes. In addition, permeability development and rate of shale oil production are controlled so that there is substantial recovery of the shale oil with minimal coking and cracking losses.

Permeability of oil shales in their native state is very low, a few millidarcies or less. Most oil shales have virtually zero porosity in their native state. Porosity develops as shale is heated to temperatures of over 200° C. from the release of bound water from some of the minerals of the shale matrix and from the thermal decomposition of kerogen to produce shale oil and gases. Recovery of the produced shale oil and gases results in the development of induced permeability. It is necessary to recover the shale oil and gases substantially as rapidly as they are produced to generate the permeability gently without substantial gross fracturing. Excessively long residence times of the produced shale oil within the hot shale matrix prior to its collection through a producer well or a tubular electrode results in degradation of the oil by coking. This results in the deposition of char inside the pore spaces and effectively blocks off the pore spaces that would otherwise be available to the flow of shale oil and gases. Continued decomposition of kerogen under these conditions results in excessive pressure build-up and the loss of valuable oil by coking.

Such results have been demonstrated in controlled laboratory experiments wherein core samples of oil shale from Colo. were heated to pyrolysis temperatures under controlled, simulated in situ conditions. In experiments conducted under fully constrained conditions, the shale sample was observed to shatter at temperatures of about 275° C. to 300° C. due to excessive pressure build-up and high heating rates. Recovery of shale oil from some of the experiments was only 20 to 30% of the total. It was not until the present invention that these difficulties were fully appreciated and methods to overcome them were provided.

The above described difficulties in producing the shale oil due to insufficient permeability development can be overcome by controlling the rate of production of shale oil and gases in the temperature range of 275° C. to 325° C., so that they can readily flow through the shale matrix without significant coking losses. This can be achieved by controlling and/or limiting the electromagnetic energy input levels so that the rate of heating of shale is within permissible limits. This has been established by laboratory experiments conducted under fully constrained conditions wherein permeabilities of the order of a few darcies have been induced and more than 90% of the total shale oil was recovered.

Figure 7:
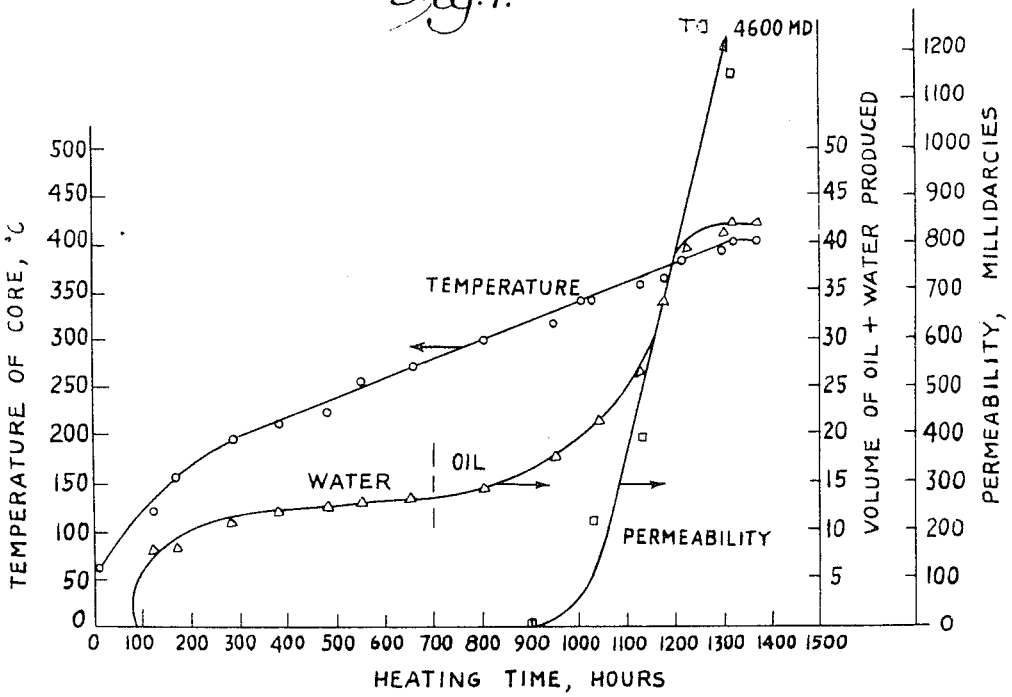
FIG. 7 is a graph showing the temperature, volume of oil and water produced and permeability as a function of time in a test on a typical Colorado oil shale from Anvil Points Mine.

FIG. 7 shows the results from one of such experiments. The data shown in FIG. 7 were obtained in a test made on an oil shale core sample from Anvil Points Mine of grade 27.7 gallons per ton. Permeability was measured parallel to bedding planes. The heating rate during pyrolysis was 0.2° C./hr. The core was sealed on the sides to the sealed reactor vessel using concrete. Temperature of the shale sample, volume of oil and water produced, and permeability as measured are shown as a function of time. It can be observed that generation of permeability starts with recovery of shale oil, and was observed to increase to 4600 millidarcies under these conditions. Heating of similar cores under similar conditions at heating rates of 1° C./hr or higher resulted in excessive pressure build-up and the shattering of the core samples into small pieces in the temperature range of about 275° C. to 300° C. More specifically, control of the heating rate to less than 0.5° C./hr., preferably to about 0.2° C./hr., was observed to control the rate of production of shale oil and gases in the temperature range of 250° C. to 300° C. so that the permeability developed in this temperature range would be sufficient to permit flow of shale oil and gases even at the higher temperatures without excessive pressure. A heating rate of the order of 0.2° C./hr. is thus used in performing the method of the present invention.

In performing the method of the present invention, it will not be necessary or desirable to fracture the shale matrix to form fissures or to vaporize water and/or part of the hydrocarbons to prevent collapse of the fissures as described in the Dauphine U.S. Pat. No. 4,193,451. Vaporization of part of the hydrocarbons to maintain the fissures is not often likely to be very effective and can result in degradation of shale oil by coking and/or cracking. The present invention thus avoids the difficulties attendant upon fracturing the shale to form fissures and the likelihood of their subsequent sealing off due to swelling and plastic flow of oil shale at temperatures over 250° C. This is especially important with the western Green River oil shales of the United States which are known to swell at temperatures over 250° C.

During thermal decomposition of large monolithic blocks of shale containing kerogen using electromagnetic energy with electrical structures 6 as described in the Bridges and Taflove United States Reissue Patent, sufficient pressures can be generated autogenously by the gases produced along with the shale oil. The pressure generated within the shale matrix depends on the rate of generation of gases and shale oil, the permeability of the shale to the flow of gases under current conditions, and the distance between the electrodes 12, 14 and 16 that form the three rows of electrodes 1, 2 and 3. The pressure $P_e$ at a point midway between two tubular electrodes 12, 14 and 16 can be calculated using the following equation:

$$P_e = \frac{q\mu \ln \frac{s}{2r_w}}{2\pi Ks} + P_w \quad (4)$$

where q is the rate of generation of gases during thermal decomposition of kerogen, $\mu$ is the average viscosity of the gases, s in the distance between two tubular electrodes 12, 14 and 16, $r_w$ is the radius of the boreholes 10, K is the permeability of the shale matrix to the flow of gases under current conditions, and $P_w$ is the pressure at the boreholes. Pressure within the shale matrix decreases with recovery of a substantial fraction of the total shale oil due to the simultaneous increase in the permeability of the shale to the flow of gases.

Figure 8:
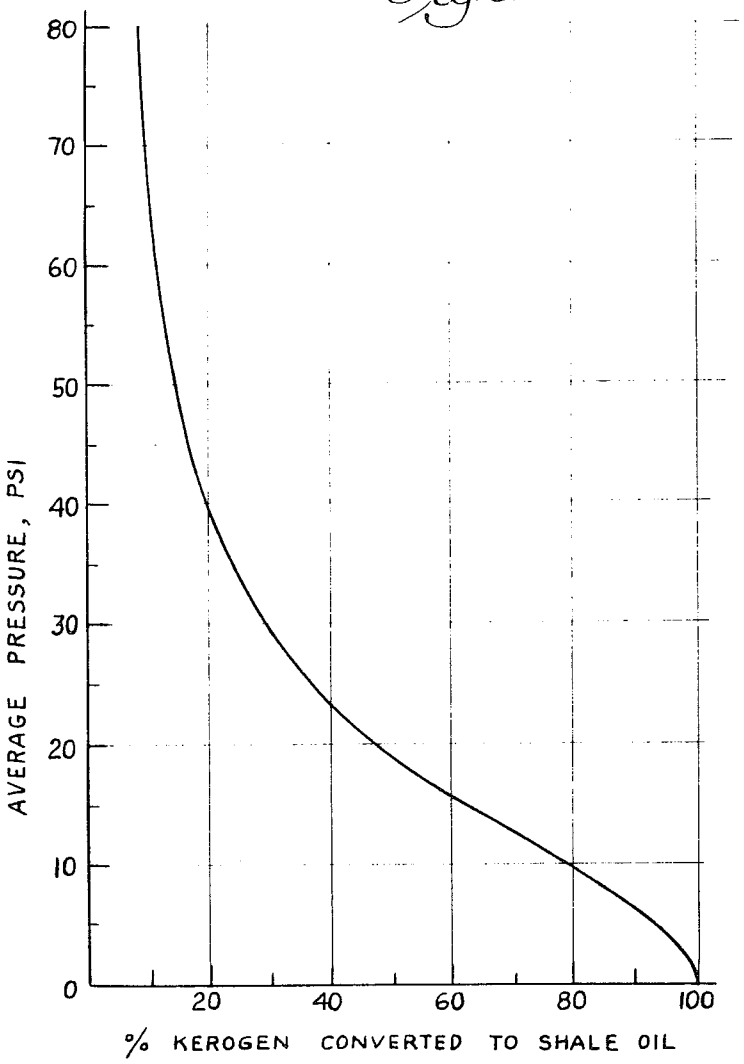
FIG. 8 is a graph showing calculated values of the pressures generated by gases produced during the decomposition of kerogen as a function of total kerogen converted in a typical Colorado oil shale.

Calculated values of pressure within the shale as a function of the percentage of total kerogen converted to shale oil are shown in FIG. 8. These pressure values were calculated for a triplate structure with adjacent electrodes 12, 14, 16 spaced at 4 meters and rows 1, 2, 3 spaced at 10 meters from each other and heated at a rate of about 0.1 C./hr during decomposition under the conditions whereby shale developed a fluid permeability of about one darcy at the end of pyrolysis. Faster heating rates increase the pressure, during the initial stages of decomposition in particular, whereas slower heating rates reduce the pressure variations from beginning to end of decomposition and make the curve flatten. Both the fluid permeability of the oil shale and the capillary pressure of the shale oil in the shale matrix depend on the size distribution and the interconnections of pore spaces induced within the hot shale upon escape of the products of pyrolysis. The measured high permeability values indicate that the capillary pressure of shale oil within the pore spaces is about 5 to 10 psi. The pressure generated by gases produced during the decomposition of kerogen is sufficient even after conversion of 95% of the total kerogen to shale oil to overcome these capillary forces that are responsible for the holdup of shale oil inside the shale matrix and to provide a drive for recovery of the shale oil through one of the boreholes 10. At the same time, the residence times for recovery of the produced oil and gases are low enough to minimize the loss of oil by coking and/or cracking.

Figure 9:
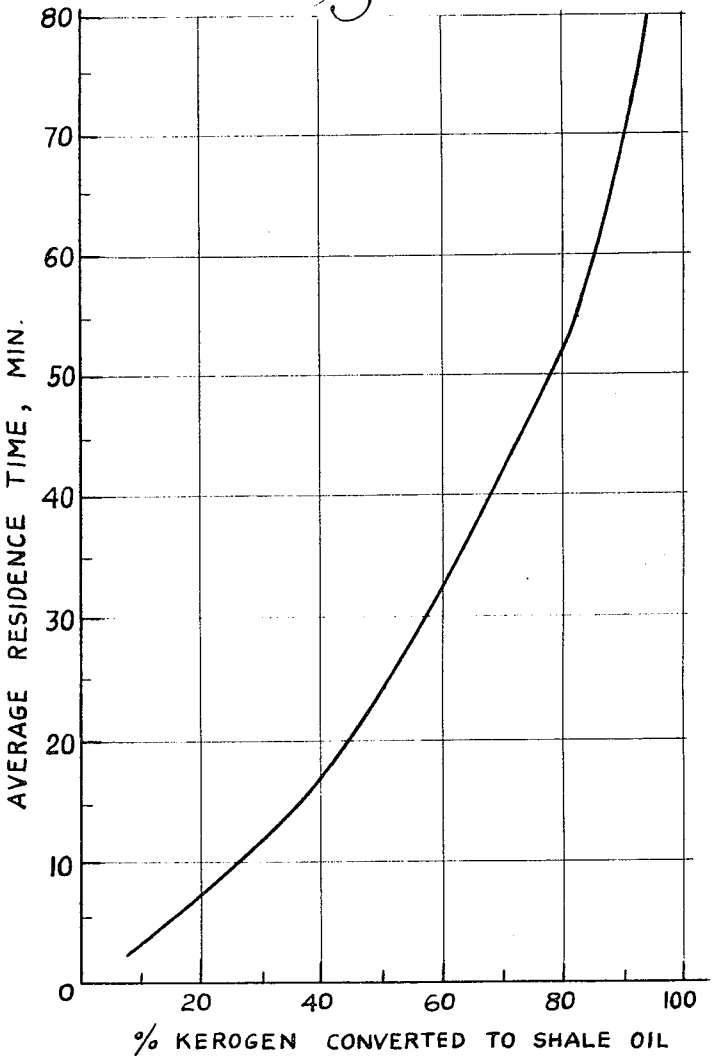
FIG. 9 is a graph of the calculated average residence time of the produced shale oil inside the shale matrix prior to its collection as a function of the percentage of the total kerogen converted in a typical Colorado oil shale.

Residence time of the produced shale oil inside the shale matrix prior to its collection through one of the boreholes 10, as calculated for the conditions described above in connection with FIG. 8, are shown in FIG. 9 as a function of the percentage of the total kerogen converted to shale oil. The loss of oil under these conditions by coking was calculated to be about 7%, and 93% of the total shale oil can be recovered at a final pyrolysis temperature of about 360° C. Under these conditions whereby the shale is made permeable, it will not be necessary to vaporize the hydrocarbons specifically to fracture the shale to improve permeability or to keep the fractures open, and the thermal decomposition can be substantially completed below a temperature of 400° C., preferably below 360° C.

Where thermal decomposition is not complete at lower temperatures, the oil shale formation may be further heated to a temperature of over 400° C. to crack the residual hydrocarbon material. This will result in recovery of additional hydrocarbons, mostly in the form of gas.

A further aspect of the present invention is to heat the deposit under confining gas pressure after recovery of a substantial fraction of the total shale oil. As the kerogen is decomposed, the permeability rises, and it is difficult to maintain high autogenous gas pressures as the gas leaks out through the highly permeable shale. At the same time, capillary pressures rise as most of the oil is driven out. The pressure generated by gases formed during decomposition of kerogen as shown in FIG. 8 may then not be adequate to overcome the current capillary forces responsible for holdup of liquid shale oil inside the pore volume after a substantial portion of the total shale oil is recovered. Heating of the formation under confined gas pressure under these conditions and the subsequent release of pressure will result in recovery of a larger fraction of the residual shale oil toward the end of the pyrolysis process by sudden puffs of gas at high pressure differentials that overcome the high capillary pressures. Heating of the formation under pressure and subsequent release of pressure can be practiced in a cyclic manner until substantially all of the hydrocarbonaceous liquids are recovered.

Objectives of this invention are to select a heating rate which will not fracture the deposit, yet will be sufficient to recover the shale oil and gases produced during the decomposition of kerogen, largely in a liquid form, by autogenously produced hydrocarbonaceous gases. Another objective is to develop induced permeability by the decomposition of kerogen to form interconnecting voids to allow the oil and gases to be driven under autogenous gas pressure into one of the producer holes.

As the heating rates necessary to accomplish the above are very low, on the order of 0.2° C./hr., heating periods of about 3 to 8 months may be required to heat the deposit from native temperature to about 350° C. Where a group of blocks is heated at the same time, significant cooling of the sides of the outside blocks of a substantially uniformly heated deposit may occur due to thermal conduction over such a long period of time. To compensate for this, the outermost electrodes of the outside blocks may be used to apply more power to the respective blocks in the vicinity of these electrodes, with the excess power used to compensate for thermal outflow on respective sides of the heated deposit. If needed, additional heat outflow mitigation can be realized by injecting steam in boreholes immediately surrounding the heated deposit. The source of steam can come from heated spent shale.

Further, the deposit may be heated hotter at the discrete electrodes to compensate for the outflow of heat to adjacent unheated regions and hence achieve greater uniformity of temperature within the deposit.

In the copending U.S. patent application of Taflove and Bridges, Ser. No. 363,765, filed Mar. 31, 1982, it is shown that the outermost excitor electrodes of the triplate line experience enhanced field intensities resulting in excessive heating. These excessive field intensities and heat can create electrical breakdown problems. On the other hand, although these can be mitigated by use of a low loss dielectric in the immediate vicinity of these electrodes, total elimination is not always necessary or practical in the slow heating method of the present invention, where thermal outflow can be offset by the excess heating of the outermost excitor electrodes.

Although particular preferred embodiments of the invention have been described with particularity, many modifications may be made therein within the scope of the invention. For example, other electrode structures may be used, and they may be disposed differently.

The invention is particularly useful for a system in which a waveguide structure is formed by electrodes disposed in earth formations, where the earth formations act as the dielectric for the waveguide, as in the triplate system illustrated. Electromagnetic energy at a selected radio frequency or at selected radio frequencies is supplied to the waveguide for controlled dissipation in the formations.

The terms "waveguide" and "waveguide structure" are used herein in the broad sense of a system of material boundaries capable of guiding electromagnetic waves. This includes the triplate transmission line formed of discrete electrodes as preferred for use in the present invention.

Unless otherwise required by the context, the term "dielectric" is used herein in the general sense of a medium capable of supporting an electric stress and recovering at least a portion of the energy required to establish an electric field therein. The term thus includes the dielectric earth media considered here as imperfect dielectrics which can be characterized by both real and imaginary components, $\epsilon'$, $\epsilon''$. A wide range of such media are included wherein $\epsilon''$ can be either larger or smaller than $\epsilon'$.

"Radio frequency" will similarly be used broadly herein, unless the context requires otherwise, to mean any frequency used for radio communications. Typically this ranges upward from 10 KHz; however, frequencies as low as 45 Hz have been considered for a world-wide communications system for submarines. The frequencies currently contemplated for oil shale deposits range as low as 100 KHz.

Mention has been made of the need for heating the formation uniformly. The object is to heat the entire block to more or less the same temperature in order that adequate autogenous gas drive may operate from deep within the block. However, it is recognized that many factors may produce variations in temperature even though the driving voltages are applied relatively uniformly to the electrodes. For example, standing waves along the electrodes may provide some variations in applied power. The use of discrete electrodes provides local heating differences. Inhomogeneities in the formation may occasion variations in dielectric or conductive heating. Thermal conductivity differences may produce differences in temperatures. Thermal conductivity will also dissipate heat from the outer parts of the block to adjacent rock. All of this is encompassed by the term "substantially uniformly", which is therefore used herein to mean that some substantial effort is made to distribute the heating so as to provide generally uniform temperatures throughout the block as a whole, and at least out in the central regions of the block, so that a substantial portion of the block becomes adequately heated for autogenous gas drive.

Heating during pyrolysis is preferably on the order of 0.2 C./hr. This does not require continuous control of heating power. At a fixed amount of power applied, the rate at which the temperature increases remains relatively constant, requiring adjustment only from time to time as the rate of temperature rise gets substantially off the desired mark.

What is claimed is:

1. A method for recovering liquid hydrocarbons from an oil shale formation containing kerogen in an inorganic matrix, said formation being substantially impermeable to fluids under native conditions, said method comprising:

substantially uniformly heating a block of said oil shale formation in situ with electromagnetic power to a temperature of about 275° C. where there is pyrolysis of a portion of said kerogen to gas and shale oil at a pressure sufficient to overcome the capillary pressure of said shale oil in said matrix, thereby providing substantial fluid permeability to said formation, utilizing said pressurized gas to drive at least portions of said gas and shale oil from said block, recovering said gas thereupon escaping from said block under said pressure and said shale oil driven by said gas, thereby further increasing the fluid permeability of said formation, and controlling the magnitude of said electromagnetic power to raise the temperature of said block relatively slowly to increase the rate of pyrolysis of said kerogen as the permeability of said formation increases to produce gas at pressures above that necessary to overcome said capillary pressure and below that at which there is substantial escape of said gas bypassing shale oil within the formation rather than driving said oil before it.

2. A method according to claim 1 wherein said electromagnetic power is applied to a plurality of electrodes bounding said block and defining a waveguide structure having said block as a dielectric medium bounded therein.

3. A method according to claim 1 wherein said electromagnetic power is applied to the electrodes of a triplate array of electrodes bounding said block and formed of a row of excitor electrodes flanked by respective rows of guard electrodes.

4. A method according to claim 3 wherein the outermost of said excitor electrodes of said row of excitor electrodes are heated more than interior excitor electrodes to offset thermal leakage to cooler surroundings.

5. A method according to claim 3 wherein said row of excitor electrodes is spaced from said respective rows of guard electrodes by 10 to 100 feet

6. A method according to any one of claims 1 to 5 wherein the magnitude of said electromagnetic power is controlled to maintain the rate of temperature rise above about 275° C. to on the order of 0.2° C. per hour.

7. A method according to claim 6 wherein the magnitude of said electromagnetic power is controlled to maintain a substantially continuous temperature rise.

8. A method according to any one of claims 1 to 5 wherein the magnitude of said electromagnetic power is controlled to maintain the rate of temperature rise above about 275° C. to less than 1° C. per hour.

9. A method according to any one of claims 1 to 5 wherein the magnitude of said electromagnetic power is controlled to maintain temperatures assuring substantial recovery of said shale oil at temperatures and presures where coking is relatively limited.

10. A method according to any one of claims 1 to 5 wherein after some permeability is developed and a fraction of the shale oil has been recovered, the substantially uniform heating is performed under confining pressure to build up autogenous gas above current capillary pressure upon pyrolysis of the kerogen, and the confining pressure is relieved from time to time to allow the autogenous gas to drive shale oil from the formation.

11. A method according to any one of claims 1 to 5 wherein after substantial permeability is developed and a substantial fraction of the shale oil has been recovered, the substantially uniform heating is performed under confining pressure to build up autogenous gas above current capillary pressure upon pyrolysis of the kerogen, and the confining pressure is relieved from time to time to allow the autogenous gas to drive shale oil from the formation.

12. A method according to any one of claims 1 to 5 wherein boundaries of a said block are locally heated more than the interior of said block to offset thermal leakage to cooler surroundings.

13. A method according to any one of claims 1 to 5 wherein a group of adjacent said blocks grouped with inner said blocks surrounded by outer said blocks are heated at the same time, and the boundaries of the outer said blocks are heated more than the inner said blocks to offset thermal leakage to cooler surroundings.

14. A method according to any one of claims 1 to 5 wherein the magnitude of said electromagnetic power is controlled to limit the current recovery ratio of gas to shale oil between predetermined limits assuring substantial recovery of said shale oil without excessive heating of said block.

* * * * *

UNITED STATES PATENT AND TRADEMARK OFFICE

CERTIFICATE OF CORRECTION

PATENT NO. : 4,485,869

DATED : December 4, 1984

INVENTOR(S) : Sresty, et al.

It is certified that error appears in the above-identified patent and that said Letters Patent is hereby corrected as shown below:

Column 3, line 50, change "C./hr" to --C/hr.--.

Column 4, line 34, delete the comma after "4".

Column 8, line 39, change "Colo" to --Colorado--.

Column 8, line 63, change "Colo." to --Colorado--.

Column 9, line 61, change "Colo." to --Colorado--.

Column 10, line 29, change "1°C./hr" to --1°C/hr.--.

Column 11, line 10, change "s in" to --s is--.

Column 11, line 24, change "0.1 C./hr" to --0.1°C/hr.--.

Column 14, line 43, after "feet" insert a period.

Column 14, line 47, delete "to".

Column 14, line 54, delete "to".

Column 14, line 58, change "presures" to --pressures--.

Signed and Sealed this

*Twenty-fifth* Day of *February 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,485,869

DATED : December 4, 1984

INVENTOR(S) : Guggilam C. Sresty, et al.

It is certified that error appears in the above-identified patent and that said Letters Patent is hereby corrected as shown below:

Column 1, after the first paragraph insert the following paragraph: --The Government of the United States of America has rights in this invention pursuant to Contract No. DE-AC01-79ER10181 awarded by the U.S. Department of Energy.--

Signed and Sealed this

Twelfth Day of December, 1989

*Attest:*

JEFFREY M. SAMUELS

*Attesting Officer*

*Acting Commissioner of Patents and Trademarks*